US010844704B2

(12) United States Patent
Jones et al.

(10) Patent No.: US 10,844,704 B2
(45) Date of Patent: Nov. 24, 2020

(54) SURFACE RECOGNITION AND DOWNLINK RECEIVER

(71) Applicant: SANVEAN TECHNOLOGIES LLC, Katy, TX (US)

(72) Inventors: Stephen Jones, Cypress, TX (US); Junichi Sugiura, Bristol (GB)

(73) Assignee: SANVEAN TECHNOLOGIES LLC, Katy, TX (US)

( * ) Notice: Subject to any disclaimer, the term of this patent is extended or adjusted under 35 U.S.C. 154(b) by 0 days.

(21) Appl. No.: 16/192,175

(22) Filed: Nov. 15, 2018

(65) Prior Publication Data

US 2020/0157931 A1 May 21, 2020

(51) Int. Cl.

| | |
|---|---|
| ***E21B 44/04*** | (2006.01) |
| ***E21B 47/12*** | (2012.01) |
| ***E21B 47/10*** | (2012.01) |

(52) U.S. Cl.

CPC ..... *E21B 44/04* (2013.01); *E21B 47/10* (2013.01); *E21B 47/12* (2013.01)

(58) Field of Classification Search

None

See application file for complete search history.

(56) References Cited

U.S. PATENT DOCUMENTS

| | | | | |
|---|---|---|---|---|
| 6,662,110 | B1 * | 12/2003 | Bargach | E21B 44/00 702/6 |
| 7,222,681 | B2 * | 5/2007 | Jones | E21B 47/12 175/38 |
| 2011/0186353 | A1 * | 8/2011 | Turner | G05B 13/048 175/40 |
| 2014/0152456 | A1 * | 6/2014 | Olson | E21B 47/12 340/853.2 |
| 2014/0284104 | A1 * | 9/2014 | Clausen | E21B 47/12 175/40 |
| 2016/0208597 | A1 * | 7/2016 | Wang | E21B 44/02 |
| 2017/0254190 | A1 * | 9/2017 | Jones | E21B 3/025 |

* cited by examiner

*Primary Examiner* — Curtis A Kuntz
*Assistant Examiner* — Jerold B Murphy
(74) *Attorney, Agent, or Firm* — Adolph Locklar

(57) ABSTRACT

A method for controlling a downhole steerable tool, such as a rotary steerable system (RSS), in a drilling system that also includes a rotating drillstring and a measurement-while-drilling (MWD) system comprises encoding an original command for the tool into an encoded signal consisting of modulations of the drillstring rotation rate, transmitting the encoded command by modulating the drillstring rotation rate, measuring the drillstring rotation rate at the tool and decoding the encoded command so as to generate a tool-decoded command, separately measuring the drillstring rotation rate and decoding the encoded command from the separate downhole-measurements so as to generate a separately downhole-decoded command, transmitting the separately downhole-decoded command to the uphole location, comparing the separately downhole-decoded command to the original command, and taking corrective action if the two commands are different.

20 Claims, 1 Drawing Sheet

SURFACE RECOGNITION AND DOWNLINK RECEIVER

TECHNICAL FIELD/FIELD OF THE DISCLOSURE

The present disclosure relates generally to systems and methods for communicating information from the surface to equipment located in a borehole, and specifically to use of variations in drill string rotation rates for communication.

BACKGROUND OF THE DISCLOSURE

When drilling a wellbore, communication of information between the surface and devices located within the wellbore may be desirable. Information that may be communicated between the surface and devices located within the wellbore may include data and commands for downhole equipment, including, but not limited to steerable drilling systems.

A hydrocarbon drilling operation may make use of control and data-collection equipment at the earth's surface and subsurface (downhole) equipment such as a drilling assembly comprising drilling apparatus, formation evaluation tools, and additional data-collection equipment. The drilling apparatus may include a bit, steerable system, mud motor, and/or other equipment. communicating between the surface equipment and the subsurface drilling assembly may be desirable.

When rotary steerable systems (RSS) are used, it may be desirable to maintain control of the RSS parameters, such as bit rotation speed, weight on bit (WOB), and flow rate. RSS systems may be classified as "point-the-bit" or "push-the-bit" systems. In point-the-bit systems, the rotational axis of the drill bit is deviated from the longitudinal axis of the drill string generally in the direction of the wellbore. The wellbore may typically be propagated in accordance with a three-point geometry defined by upper and lower stabilizer touch points and the drill bit. The angle of deviation of the drill bit axis, coupled with a finite distance between the drill bit and the lower stabilizer, results in a non-collinear condition that generates a curved wellbore. In push-the-bit systems, the non-collinear condition may be achieved by causing one or both of upper and lower stabilizers, for example via blades or pistons, to apply an eccentric force or displacement to the BHA to move the drill bit in the desired path. Steering may be achieved by creating a non-collinear condition between the drill bit and at least two other touch points, such as upper and lower stabilizers, for example. In either case, it may be desirable to send specific commands to the downhole equipment throughout the drilling process so as to as to achieve the desired drill path.

In some instances, downlink signaling, i.e., communicating from the surface equipment to the downhole equipment, may be used to provide instructions in the form of commands to the drilling assembly. For example, in a directional drilling operation, downlink signals may direct the drilling apparatus to alter the direction of the drill bit trajectory or to change the magnitude of trajectory change.

Similarly, uplink signaling, i.e., communicating between the downhole equipment and the surface equipment, may be used to verify the downlink instructions and/or to communicate data or analyses collected downhole, referred to herein as "downhole-measurements."

One technique for transmitting signals in a well is mud pulse telemetry. Drilling a well typically entails pumping fluid into and out of the well to facilitate drilling and carry cuttings out of the hole. A downhole sensor or receiver may be provided in or on the drilling assembly to meter the flowrate of the drilling fluid (mud) and/or sense the pressure. Mud pulse telemetry entails sending signals by creating a series of pressure pulses in the drilling fluid, which pulses can be detected by a receiver. For downlink signaling, the pattern of pressure pulses, including the pulse duration, amplitude, phase, time between pulses and combinations thereof, may be detected by the downhole receiver and then interpreted as a particular instruction or command. Mud pulse telemetry may have disadvantages, including disruption of the drilling process and relatively high inefficiency and inaccuracy.

In certain instances, communication between the surface and various downhole equipment may be accomplished by modulating other aspects of the drilling operation, such as by modifying the flow rate of fluids through the drillstring, the amount of weight which is placed on the bit, or the rotation rate (revolutions per minute or RPM) of the drillstring or bit. By altering these aspects of the drilling operations and detecting the modulations downhole, coded sequences may be sent from the surface to the downhole equipment, where sensors may detect the coded sequences.

SUMMARY

The present disclosure provides a method for controlling, from an uphole location, a downhole steering tool in a drilling system that also includes a rotating drillstring and a measurement-while-drilling (MWD) system. The method may comprise a) encoding an original command for the downhole steering tool into an encoded signal consisting of modulations of the drillstring rotation rate; b) transmitting the encoded command by modulating the drillstring rotation rate at the uphole location; c) measuring the drillstring rotation rate at the downhole steering tool and decoding the encoded command from the measurements at the downhole steering tool so as to generate a tool-decoded command; d) measuring the drillstring rotation rate at a downhole location that is separate from the downhole steering tool and decoding the encoded command from the downhole-measurements so as to generate a downhole-decoded command; e) transmitting the downhole-decoded command to the uphole location; f) comparing the downhole-decoded command to the original command; and g) taking corrective action if the downhole-decoded command is different from the original command. The downhole location may be at the MWD and the downhole steering tool may be a rotary steerable system (RSS).

The drilling system may include a mud-operated power section and the downhole location may be below or above the other mud-operated power section. The method may further include the steps of calculating a mud motor-generated RPM based on a fluid flow rate input and adding the calculated mud motor-generated RPM to the RPM measured in step d). The fluid flow rate may be constant or the fluid flow rate may fluctuate and may be measured by a fluid flow rate sensor or be estimated using readings from a pressure sensor.

Step g) may comprise an action selected from the group consisting of: re-transmitting the original command, transmitting a modified command that reflects the correction needed to recover the desired bit trajectory, and transmitting a new command to go to a known state. The method may further include the steps of h) measuring the drill string rotation rate at the uphole location and decoding the encoded command from the uphole-measurements so as to generate a uphole-decoded command and i) comparing the uphole-decoded command to either the original command or the downhole-decoded command.

The original command may be selected from the group consisting of commands to: modify offset, modify toolface, enter automated steering mode (e.g. hold mode), modify target inclination, modify target azimuth, modify target dog-leg, modify surface-measured drilling speed, modify hold-mode gain change, enter uplink telemetry mode, enter pad/blade extend mode, and enter pad/blade retract mode.

Rotation of the drill string may be manually controlled or controlled by an automatic rotation (speed) controller.

In other embodiments, a method for controlling, from an uphole location, a downhole steering tool in a drilling system that also includes a rotating drillstring and a measurement-while-drilling (MWD) system may comprise a) encoding an original command for the downhole steering tool into an encoded signal consisting of modulations of the drillstring rotation rate; b) transmitting the encoded command by modulating the drillstring rotation rate at the uphole location; c) measuring the drillstring rotation rate at the downhole steering tool and decoding the encoded command from the tool-measurements so as to generate a tool-decoded command; d) measuring the drillstring rotation rate at an uphole location and decoding the encoded command from the uphole-measurements so as to generate an uphole-decoded command; e) comparing the uphole-decoded command to the original command; and f) taking corrective action if the uphole-decoded command is different from the original command. The uphole location may be at the surface and the downhole steering tool may be a rotary steerable system (RSS).

The drilling system may include a mud motor and the method may further include the steps of g) calculating a mud motor-generated RPM based on a fluid flow rate input; and h) adding the calculated mud motor-generated RPM to the RPM measured in step d). The fluid flow rate may be constant or the fluid flow rate may fluctuate and be measured by a fluid flow rate sensor.

The original command may be selected from the group consisting of commands to: modify offset, modify toolface, enter automated steering mode (hold mode), modify target inclination, modify target azimuth, modify target dog-leg, modify surface-measured drilling speed, modify hold-mode gain change, enter uplink telemetry mode, enter pad/blade extend mode, and enter pad/blade retract mode. Rotation of the drill string may be manually controlled or may be controlled by an automatic rotation controller.

BRIEF DESCRIPTION OF THE DRAWING

The present disclosure is best understood from the following detailed description when read with the accompanying FIGURE. It is emphasized that, in accordance with the standard practice in the industry, various features are not drawn to scale. In fact, the dimensions of the various features may be arbitrarily increased or reduced for clarity of discussion.

The FIGURE depicts a schematic view drilling system consistent with at least one embodiment of the present disclosure.

DETAILED DESCRIPTION

Figure 1:
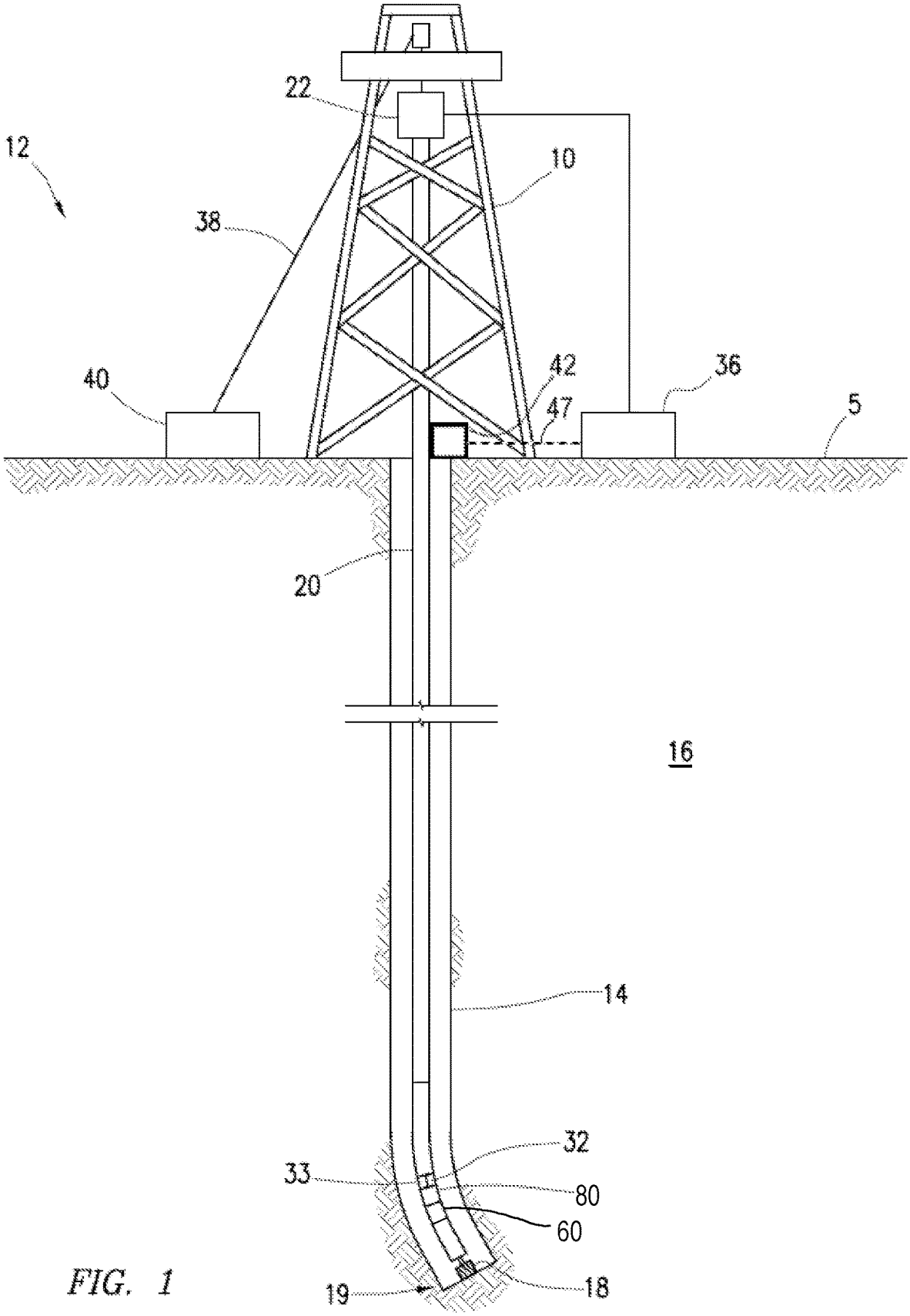

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

The FIGURE depicts a drilling system 12 that includes a derrick 10 positioned at the surface 5 and a drill string 20 extending into a borehole 14 in the subsurface 16. A top drive 22 is suspended from derrick 10 and connected to a drawworks 40 by a line 38. Top drive 22, in conjunction with drawworks 40 and line 38, may raise and lower drill string 20 into borehole 14. Drill string 20 may include a drill bit 18, a downhole tool 60, and, optionally, a mud-operated power section 80, all positioned at the lower end 19 of drill string 20. Mud-operated power section 80 may be a motor, turbine, gear-reduced turbine or any other mud-operated power component. Downhole tool 60 may be any downhole tool to which a command or data may be sent and may include, for example and without limitation, a directional drilling tool, a rotary steerable system (RSS), a rotary steerable motor, a turbine assisted RSS, a gear-reduced turbine assisted RSS, a steerable coiled tubing tool, a steerable turbine, a vibratory tool, an oscillation tool, a friction reduction tool, a shock tool, a vibration/shock damper tool, a jarring tool, a reamer, or an independent sub.

In certain embodiments, drill string 20 may be rotated by top drive 22, although one having ordinary skill in the art with the benefit of this disclosure will understand that a rotary table may be utilized to rotate drill string 20 as described herein without deviating from the scope of this disclosure. In some embodiments, the rotation of drill string 20 by top drive 22 may be controlled by a rotation controller 36. Rotation controller 36 may be manually or automatically controlled. Rotation controller 36 may, for example and without limitation, control the rate of rotation of drill string 20 as discussed below.

In some embodiments, drill string 20 may include one or more rotation rate sensors 32 positioned downhole to measure the rotation rate of drill string 20. Rotation rate sensors 32 may be used to measure the rotation rate of drill string 20 at the location of rotation rate sensor 32 along drill string 20. Depending on the type and configuration of downhole tool 60, one or more rotation rate sensors 32 may, in some embodiments, be positioned at one or more locations, which may include a location that rotates with drill string 20, a location that remains generally stationary with respect to wellbore 14, a location that rotates at a different rate than drill string 20 relative to wellbore 14, or a location that may rotate or not rotate depending on the operating mode of downhole tool 60 or operating conditions in wellbore 14. In some embodiments, rotation rate sensor 32 may include, for example and without limitation, one or more accelerometers, magnetometers, and/or gyroscopic (angular-rate) sensors, including micro-electro-mechanical system (MEMS) gyros and/or others operable to measure cross-axial acceleration and/or magnetic field components. Additional details regarding rotation sensing are set out in commonly-owned U.S. application Ser. No. 15/441,087, which is incorporated herein by reference.

In some embodiments, rotation rate sensor 32 may be in data connection with a downhole decoder 33 and both rotation rate sensor 32 and downhole decoder 33 may be positioned on a measurement-while-drilling (MWD) tool that may or may not include additional MWD sensors. The MWD tool may be above downhole tool 60, wherein "above" refers to closer to the surface along drill string 20. In other embodiments, rotation rate sensor 32 and downhole decoder 33 may be positioned downhole tool 60 and at or near drill bit 18.

In addition to rotation rate sensor 32 or alternatively, an uphole rotation sensor 42 may be provided at or near the surface or in borehole 14 so as to measure the RPM of drill string 20 at a location at or near the surface. Data from uphole rotation sensor 42 can be used, in conjunction with a known or predicted fluid flow rate and mud motor specification (in revolutions per gallon) if needed, to calculate a bit RPM. Uphole rotation sensor 42 may be connected by a communication line 47 to a controller, which may be rotation controller 36, as shown, or a separate controller. Rotation and fluid flow data may be transmitted to an uphole decoder (not shown) that may be provided as part of rotation controller 36 or may be provided as a separate device. Like, downhole decoder 33, the uphole decoder may be configured to receive and interpret commands in encoded messages based on RPM values of drill bit 18.

In operation, rotation controller 36 may control the rotation of drill string 20 in such a manner as to communicate a command and/or data to downhole tool 60 positioned on drill string 20. In some embodiments, a constant fluid flow rate is used and/or presumed. In other embodiments, the fluid flow rate may be modulated as part of the signal-sending.

As discussed in detail below, equipment downhole may be configured to recognize, interpret, and implement the command and/or data.

The command may be an input or any other signal to be sent to downhole tool 60. In some embodiments, the command may be selected from a preselected set of command types based on the type of downhole tool 60. In some embodiments, the command may be to modify a downhole tool parameter, such as a change in the operational state of downhole tool 60, a modification to a previous command, a wake-up signal, a sleep (power-save) signal, a blade-collapse signal, an all-blade-extend signal, a tool activation signal, a tool deactivation signal, a desired hydraulic valve position, a trigger, a modification to a parameter of downhole tool 60, a diagnostics mode in which diagnostic parameters are sent up for troubleshooting, e.g. high electronics current, sensor failure, etc., or any other desired input to the operation of downhole tool 60. For example, during a drilling operation, it may be desired to send a command to downhole tool 60 to change the downhole tool parameter. The command components may include a type of command, an indication of the parameter to be changed, and a value representing the change in parameter or a desired operating mode.

In the disclosure below, messages, data, and commands may be discussed with respect to a directional drilling tool and more specifically to an RSS, but one having ordinary skill in the art with the benefit of this disclosure will understand that downhole tool 60 may be any downhole tool and may receive any commands or data associated therewith in accordance with embodiments of the present disclosure.

Thus, for example and without limitation, the available commands to be sent may include modifications to toolface, offset, or operating mode of downhole tool 60. One having ordinary skill in the art with the benefit of this disclosure will understand that these tool parameters may be referred to with different terminology depending on the type of steerable system. For example, toolface and offset may be referred to or defined in terms of, for example and without limitation, force vector toolface, pressure vector toolface, position vector toolface, force vector magnitude, pressure vector magnitude, position offset magnitude, eccentric distance, and steering ratio. One having ordinary skill in the art with the benefit of this disclosure will understand that the terms toolface and offset do not limit the scope of this disclosure to any particular measure or definition of drilling direction and curvature magnitude.

In some embodiments, the command or data may be translated into a message. In some embodiments, the message may be generated from the command or data based on a predetermined syntax. The predetermined syntax may be selected based on which downhole tool 60 is utilized and the available commands to be sent thereto. In some embodiments, the message may be a sequence of codes into which the command is parsed based on the predetermined syntax. In some embodiments, the code values of one or more codes of the message may identify the type of command, and other code values may contain the content or data of the command. The predetermined syntax may determine the meaning of each code of the message based on the type of command or data. The content of the command may include, for example and without limitation, a value for a parameter of downhole tool 60 or a selected operating mode.

Once the message is generated, the message may be encoded into a transmittable signal. In embodiments where the transmission means is RPM modulation, the transmittable signal is a series of drill string rotation steps that can be detected downhole.

In some embodiments, downhole tool 60 may include a tool rotation sensor and a tool controller (not shown) that includes a programmable processor such as a microprocessor or a microcontroller and processor-readable or computer-readable programming code embodying logic embedded on tangible, non-transitory computer readable media, including instructions for controlling the function of downhole tool 60. The tool controller may receive a command encoded in the rotation rate (RPM) of drill string 20, as sensed by the tool rotation sensor. The tool controller may receive and decode the command and then implement the command so as to cause downhole tool 60 to execute the command.

The tool controller may also optionally communicate with other instruments in the drill string, such as telemetry systems that communicate with surface 5. It will be appreciated that the tool rotation sensor and the tool controller are not necessarily located in downhole tool 60 and may be positioned elsewhere in drill string 20 in electronic communication with the directional drilling tool. Moreover, one skilled in the art with the benefit of this disclosure will understand that the multiple functions performed by the tool controller may be distributed among a number of devices.

For various reasons, which can include operator error, equipment malfunction, and downhole conditions, the command received at the downhole tool may not match the command that was intended to be transmitted. A second measurement of the bit RPM can form the basis for a signal confirmation. A second measurement can be provided either downhole, such as by rotation rate sensor 32, or uphole, such as by uphole rotation sensor 42.

If a mud motor or other mud-operated power section is present and a downhole rotation rate sensor 32 is positioned below the motor, the RPM measured by rotation rate sensor 32 will equal the RPM of drill bit 18.

Similarly, if no mud motor is present, the RPM measured by either rotation rate sensor 32 or an uphole rotation sensor 42 will equal the RPM of drill bit 18.

If a mud motor is present and either an uphole rotation sensor 42 or a downhole rotation rate sensor 32 positioned above the motor is used, it will be necessary to add the motor-generated RPM to the RPM measured by rotation rate sensor 32 in order to calculate the RPM of drill bit 18. One way to estimate the motor-generated RPM is to measure the fluid (mud) flow rate and use the measured flow rate to calculate the motor rotation rate using the revolutions-per-gallon factor given by the motor specification. Another way to estimate the motor-generated RPM is to use a constant fluid flow rate and use the constant flow rate to calculate the motor rotation rate. In some embodiments, a constant flow rate may be presumed and a flow switch included in the MWD tool may be used to indicate flow status.

If the RPM measurements are made downhole, downhole decoder 33 may receive measured drill string rotation data from rotation rate sensor 32 and flow status data from the flow switch and may use the received data as inputs for decoding a command message. The command decoded by downhole decoder 33 can be transmitted by the MWD tool to the surface or to an uphole location and compared there to the original command sent by rotation controller 36. If the two commands are not the same, it may be desirable to take corrective action so as to ensure that the bit follows the desired path through the formation.

Similarly, if the RPM measurements are made uphole, the uphole decoder may receive measured drill string rotation data from rotation sensor 42 and, if needed, flow status data from the flow switch and may use the received data as inputs for decoding a command message. Also, the flow rate may be calculated at surface from pump strokes and fluid volume. The command decoded by the uphole decoder can be compared to the original command. If the two commands are not the same, it may be desirable to take corrective action so as to ensure that the bit follows the desired path through the formation.

In some embodiments, a downhole-decoded signal may be recorded in memory, such as at the MWD tool, so that it is available for a post-run analysis. In some embodiments, a surface-decoded signal may be analyzed in real-time at a remote (operation) monitoring center. If there is a discrepancy between an MWD-decoded signal and an uphole-decoded signal, the former may be given more weight.

By measuring the rotation rate of the drill string and decoding the rotation data at a decoder that is separate from the downhole tool, it is possible to empirically determine whether an intended command has been successfully encoded and transmitted. Because it may be more difficult to transmit signals from the downhole tool for which the command is intended, using a separate system to detect and decode a transmitted signal may allow for easier transmission of the data needed to confirm transmission.

In an exemplary embodiment, the downhole tool comprises an RSS and the drilling system includes a rotating drillstring and an MWD tool. Rotation controller 36 may encode an original command for the RSS into an encoded signal consisting of modulations of the drillstring rotation rate and transmit the encoded command by modulating the drillstring rotation rate at the uphole location. The RSS measures the bit rotation rate and decodes the encoded command from the RSS-measurements so as to generate an RSS-decoded command. Concurrently, the MWD tool may measure the drillstring rotation rate downhole. If a mud motor (turbine, or gear-reduced turbine) is being used, the MWD may also measure the fluid flow rate through the mud motor or presume a constant, known fluid flow rate, so that a calculated mud motor-generated RPM can be added to the drill string RPM. The sum of the mud motor-generated RPM and the drill string RPM will approximate the bit RPM as measured by the RSS. Using the calculated bit RPM, downhole decoder 33 may decode the encoded command, thereby generating an MWD-decoded command. The MWD tool may transmit the MWD-decoded command to the uphole location using mud pulse telemetry, acoustic telemetry, wired drill pipe, or a combination thereof, where the MWD-decoded command is compared to the original command. If the MWD-decoded command is different from the original command, corrective action may be taken, such as, for example, re-transmitting the original command, transmitting a modified command that reflects the correction needed to recover the desired bit trajectory, or, if a downhole decoding error is suspected, a new command may be sent to go to a known state such as "sleep" or "wake-up."

The use of the MWD tool to transmit the decoded command reduces the need to use limited RSS bandwidth for transmitting signal confirmation data and may provide a cost-effective way to get downlink confirmation other than directly from an RSS, thereby avoiding the need to wire the RSS or implement a separate short hop communication from RSS to MWD.

In another exemplary embodiment, the drillstring rotation rate may be measured at the uphole location and may be used, along with fluid flow information as described above, to decode the encoded command at an uphole-decoder.

The ability of the present system to confirm accurate transmission of a command to a downhole tool without using the telemetry bandwith of the tool itself, sometimes also referred to herein as "downlink recognition," can result in more efficient drilling control and, in turn, more accurate adherence to a prescribed drill path. The downlink recognition software can be stand-alone or may be added to other drilling control software. For example, downlink recognition software can be run in conjunction with drilling optimization software.

While the foregoing discussion has described the invention in terms of measuring the rotation rate of the drill string, it will be understood that the measurement, detection, and confirmation of transmitted commands described herein can be applied to commands transmitted by other means, including but not limited, fluid flow rates, pressure pulses, weight on bit, and combinations thereof. Similarly, the downhole decoder need not be associated with the MWD; it can comprise a separate, add-on module. In either case, at least the downhole decoder or MWD tool may include a pressure telemetry decoder module.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

What is claimed is:

1. A method for controlling, from an uphole location, a downhole steering tool in a drilling system that also includes a rotating drillstring and a measurement-while-drilling (MWD) system, the method comprising:

a) encoding an original command for the downhole steering tool into an encoded signal consisting of modulations of the drillstring rotation rate;

b) transmitting the encoded command by modulating the drillstring rotation rate at the uphole location;

c) measuring the drillstring rotation rate at the downhole steering tool and decoding the encoded command from the measurements at the downhole steering tool so as to generate a tool-decoded command;

d) measuring the drillstring rotation rate at a second downhole location that is separate from the downhole steering tool and decoding the encoded command from the downhole-measurements so as to generate a downhole-decoded command;

e) transmitting the downhole-decoded command to the uphole location;

f) comparing the downhole-decoded command to the original command; and g) taking corrective action if the downhole-decoded command is different from the original command.

2. The method according to claim 1 wherein the second downhole location is at the MWD.

3. The method according to claim 1 wherein the drilling system includes a mud-operated power section and the second downhole location is below the mud-operated power section.

4. The method according to claim 1 wherein the drilling system includes a mud motor and the second downhole location is above the mud motor, further including the steps of:

calculating a mud motor-generated RPM based on a fluid flow rate input; and adding the calculated mud motor-generated RPM to the RPM measured in step d).

5. The method according to claim 4 wherein the fluid flow rate is constant.

6. The method according to claim 4 wherein the fluid flow rate fluctuates and is provided by a fluid flow rate sensor.

7. The method according to claim 1 wherein step g) comprises an action selected from the group consisting of: re-transmitting the original command, transmitting a modified command that reflects the correction needed to recover the desired bit trajectory, and transmitting a new command to go to a known state.

8. The method according to claim 1 wherein the original command is selected from the group consisting of commands to: modify offset, modify toolface, enter diagnostics mode, enter hold mode, modify target inclination, modify target azimuth, modify target dog-leg, modify surface-measured drilling speed, modify hold-mode gain change, enter uplink telemetry mode, enter pad/blade extend mode, and enter pad/blade retract mode.

9. The method of claim 1 wherein rotation of the drill string is manually controlled.

10. The method of claim 1 wherein rotation of the drill string is controlled by an automatic rotation controller.

11. The method according to claim 1, further including:

h) measuring the drillstring rotation rate at the uphole location and decoding the encoded command from the uphole-measurements so as to generate a uphole-decoded command; and i) comparing the uphole-decoded command to either the original command or the downhole-decoded command.

12. The method according to claim 1 wherein the downhole steering tool is a rotary steerable system (RSS).

13. A method for controlling, from an uphole location, a rotary steerable system (RSS) in a drilling system that also includes a rotating drillstring and a measurement-while-drilling (MWD) system, the method comprising:

a) encoding an original command for the RSS into an encoded signal consisting of modulations of the drillstring rotation rate;

b) transmitting the encoded command by modulating the drillstring rotation rate at the uphole location;

c) measuring the drillstring rotation rate at the RSS and decoding the encoded command from the RSS-measurements so as to generate an RSS-decoded command;

d) measuring the drillstring rotation rate at an uphole location and decoding the encoded command from the uphole-measurements so as to generate an uphole-decoded command;

e) comparing the uphole-decoded command to the original command; and f) taking corrective action if the uphole-decoded command is different from the original command.

14. The method according to claim 13 wherein the uphole location is at the surface.

15. The method according to claim 13 wherein the drilling system includes a mud motor, further including the steps of:

g) calculating a mud motor-generated RPM based on a fluid flow rate input; and h) adding the calculated mud motor-generated RPM to the RPM measured in step d).

16. The method according to claim 15 wherein the fluid flow rate is constant.

17. The method according to claim 15 wherein the fluid flow rate fluctuates and is provided by a fluid flow rate sensor.

18. The method according to claim 13 wherein the original command is selected from the group consisting of commands to: modify offset, modify toolface, enter diagnostics mode, enter hold mode, modify target inclination, modify target azimuth, modify target dog-leg, modify surface-measured drilling speed, modify hold-mode gain change, enter uplink telemetry mode, enter pad/blade extend mode, and enter pad/blade retract mode.

19. The method of claim 13 wherein rotation of the drill string is manually controlled.

20. The method of claim 13 wherein rotation of the drill string is controlled by an automatic rotation controller.

* * * * *